US008602418B1

(12) United States Patent
Hering et al.

(10) Patent No.: US 8,602,418 B1
(45) Date of Patent: Dec. 10, 2013

(54) PROJECTILE TRAP ASSEMBLY

(75) Inventors: Steven Fred Hering, Lawrenceville, GA (US); Carter Crittenden Bennett, Sugar Hill, GA (US); Bradley Michael Malta, Buford, GA (US); David O'Meara, Buford, GA (US)

(73) Assignee: Meggitt Training Systems, Inc., Suwanee, GA (US)

( * ) Notice: Subject to any disclaimer, the term of this patent is extended or adjusted under 35 U.S.C. 154(b) by 225 days.

(21) Appl. No.: 12/917,464

(22) Filed: Nov. 1, 2010

Related U.S. Application Data

(60) Provisional application No. 61/307,841, filed on Feb. 24, 2010.

(51) Int. Cl.
*F41J 13/00* (2009.01)

(52) U.S. Cl.
USPC ..... 273/410

(58) Field of Classification Search
USPC ..... 273/404–410; 89/36.02
See application file for complete search history.

(56) References Cited

U.S. PATENT DOCUMENTS

| | | | | |
|---|---|---|---|---|
| 2,013,133 A | | 9/1935 | Caswell | |
| 3,737,165 A | * | 6/1973 | Pencyla | 273/410 |
| 5,070,763 A | | 12/1991 | Coburn | |
| 5,400,692 A | | 3/1995 | Bateman | |
| 5,486,008 A | | 1/1996 | Coburn | |
| 5,655,775 A | * | 8/1997 | Pontus et al. | 273/410 |
| 5,715,739 A | | 2/1998 | White | |
| 5,811,718 A | * | 9/1998 | Bateman | 273/410 |
| 5,822,936 A | | 10/1998 | Bateman | |
| 6,530,572 B1 | | 3/2003 | Overley | |
| 7,194,944 B2 | | 3/2007 | Lambert et al. | |
| 7,275,748 B2 | | 10/2007 | Lambert et al. | |
| 7,434,811 B1 | | 10/2008 | Coburn et al. | |
| 7,775,526 B1 | | 8/2010 | Lambert et al. | |
| 2005/0034594 A1 | | 2/2005 | Parks et al. | |
| 2009/0000961 A1 | | 1/2009 | Heller et al. | |
| 2009/0096173 A1 | | 4/2009 | Bateman et al. | |

FOREIGN PATENT DOCUMENTS

WO WO 94/27111 11/1994

OTHER PUBLICATIONS

Snail Systems Deceleration Chamber, found at http://snailtraps.com/popups/circularDeceleration.htm, in use at least as early as Aug. 20, 2007.

All clean on the firing range, found at http://machinedesign.com/technologies/all-clean-firing-range, retrieved from the internet Dec. 10, 2009.

(Continued)

*Primary Examiner* — Mark Graham
(74) *Attorney, Agent, or Firm* — Smith, Gambrell & Russell, LLP

(57) ABSTRACT

An improved projectile trap assembly includes a frame that supports a channel and a containment chamber. The containment chamber has an ingress point receiving a fired bullet and an egress point for distributing the bullet. The containment chamber is supported by a pair of bulkhead plates that are connected to the frame. Each bulkhead plate defines an aperture, with a scroll assembly being mounted between bulkhead plates proximate the aperture. The scroll assembly includes a front scroll affixed and a rear scroll detachably connected to the bulkhead plates. A side plate is detachably connected to the bulkhead plate opposite said front and rear scrolls to seal the scroll assembly to receive bullets. The containment chamber additionally includes upper and lower trap plates that are positioned proximate upper and lower channel plates at the ingress point. Finally, a plurality of collection buckets positioned below said front scroll in an adjustable position.

20 Claims, 22 Drawing Sheets

(56) References Cited

OTHER PUBLICATIONS

Sovine, Addison, "Choosing the Optimal Bullet Trap—Action Target's Total Containment Trap" found at www.actiontarget.com; copyright date 2011, accessed Dec. 10, 2009.

SRI's Vertical Chamber, found at http://www.ais-sim.com/shooting_ranges/shooting_r anges_bullet_traps.htm, retrieved from the internet Dec. 10, 2009.

Metallic Bullet Traps, found at http://www.patriotrange.com/static.asp? path=55,330, retrieved from the internet Dec. 10, 2009.

* cited by examiner

PROJECTILE TRAP ASSEMBLY

CROSS REFERENCE TO RELATED PATENT APPLICATIONS

The present application claims priority from U.S. Provisional Patent App. No. 61/307,841, filed on Feb. 24, 2010, which is relied upon and incorporated herein by reference.

BACKGROUND OF THE INVENTION

Firearms training and testing frequently requires the use of live weapons and ammunition, and there are various ways of stopping and collecting the bullets fired in these situations. That is, bullet traps have been in use for over a century in different styles and types of traps. The steel type has gained popularity in recent years because of the ability to better capture the lead and other projectile by-products, reducing environmental impact of the trap system.

Scroll traps, so named for their characteristic cylindrical shape, slow down the projectiles by decelerating them in a circular or multi-faceted chamber. The bullets are usually led into this chamber by striking a series of plates designed to direct the bullets smoothly into the entrance, or throat of the chamber. Once inside the chamber, the bullets are slowed down as gradually as possible to generate the least amount of particulate debris. The bullets and fragments are then collected by a variety of means and disposed from the bullet trap.

BRIEF SUMMARY OF THE INVENTION

An improved projectile trap assembly includes a frame that supports a channel and a containment chamber. The containment chamber has an ingress point receiving a fired bullet and an egress point for distributing the bullet. The containment chamber is supported by a pair of bulkhead plates that are connected to the frame. Each bulkhead plate defines an aperture, with a scroll assembly being mounted between the bulkhead plates proximate the aperture. The scroll assembly includes a front scroll affixed between bulkhead plates as well as a rear scroll detachably connected to the bulkhead plates. A side plate is detachably connected to the bulkhead plate opposite said front and rear scrolls to seal the scroll assembly to receive bullets. The containment chamber additionally includes upper and lower trap plates that are positioned proximate upper and lower channel plates at the ingress point. Finally, a plurality of collection buckets positioned below said front scroll in an adjustable position.

DETAILED DESCRIPTION OF THE PREFERRED EMBODIMENTS

An improved projectile or bullet trap assembly 10 for safely capturing fired bullets or projectiles 6, storing the fired bullets 6 in an easily dispensable apparatus 60, and allow simple access into the components of the assembly for desired cleaning and maintenance of the assembly 10 is described herein and illustrated in FIGS. 1-22.

Figure 1:
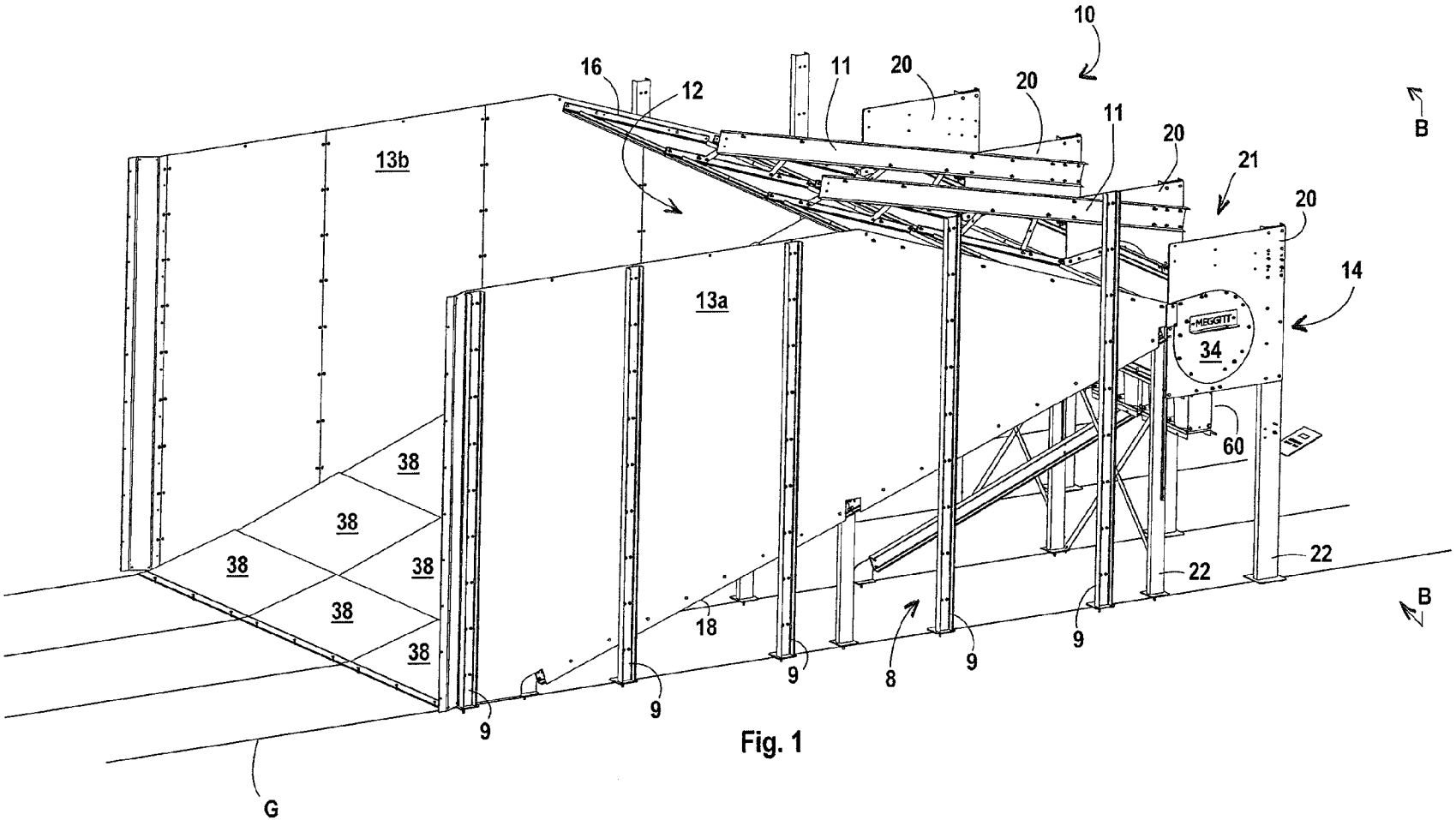
FIG. 1 is a front perspective view of an improved projectile trap assembly.
Figure 2:
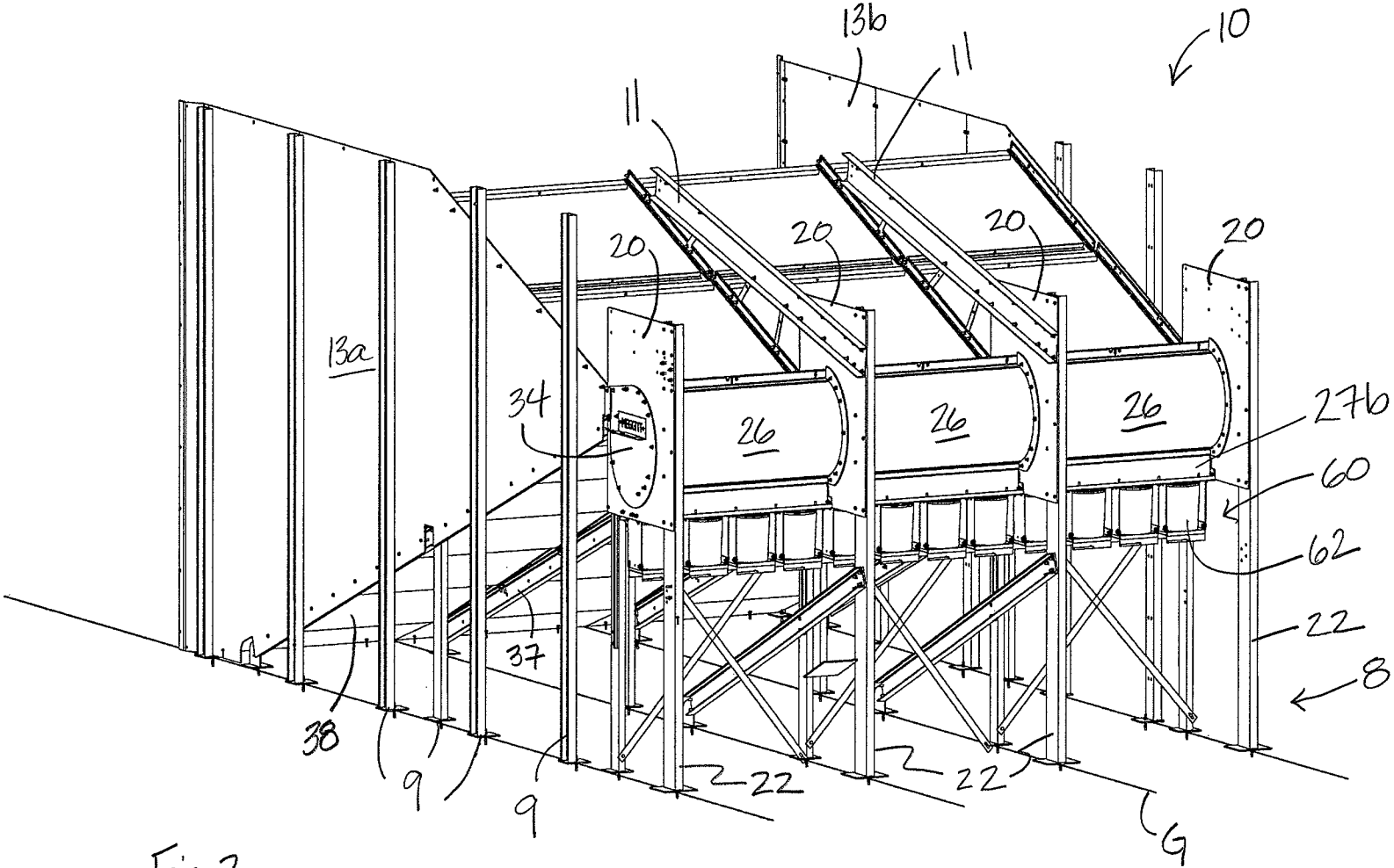
FIG. 2 is a rear perspective view of the improved projectile trap assembly.
Figure 3:
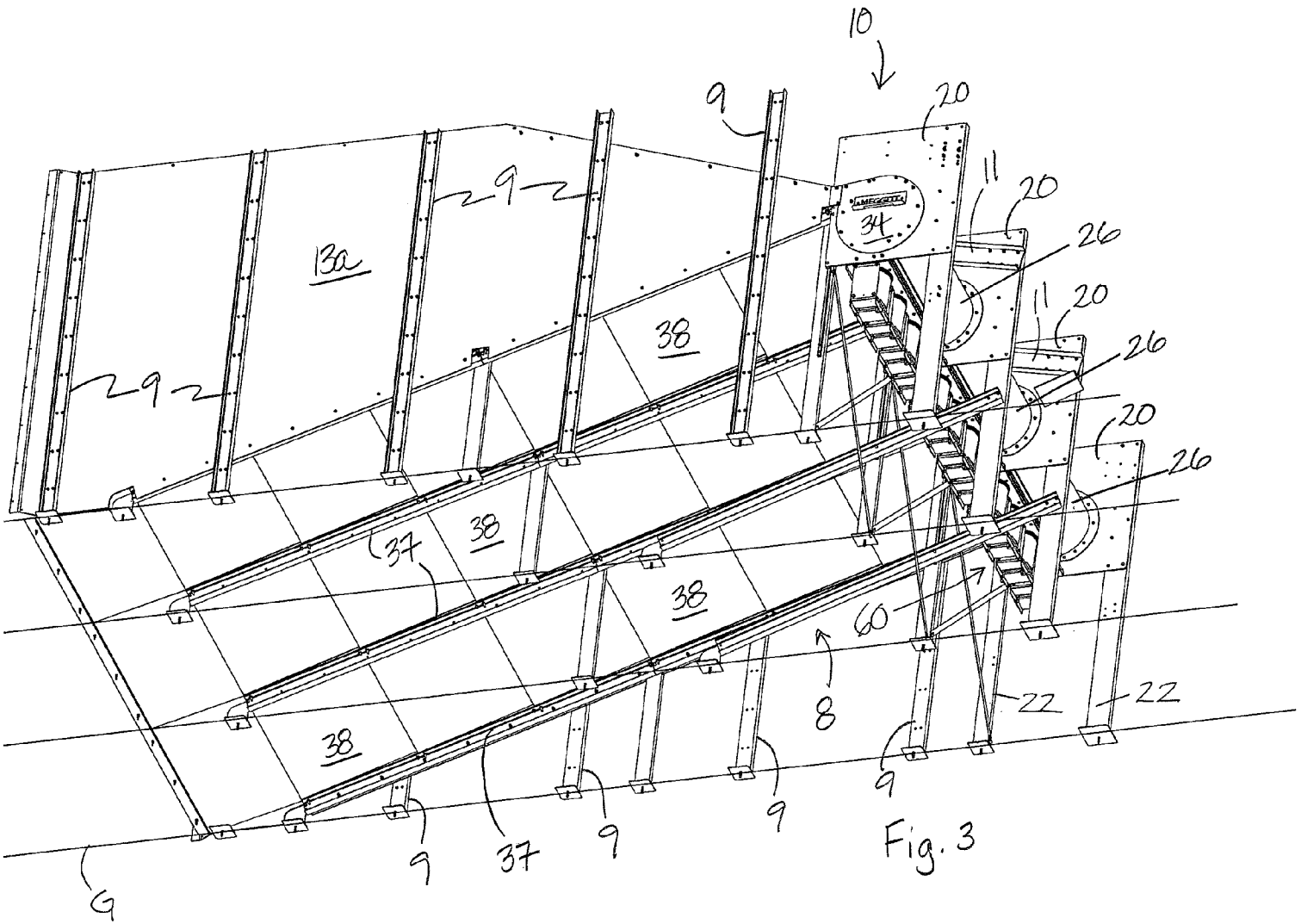
FIG. 3 is a bottom perspective view of the improved projectile trap assembly.
Figure 4:
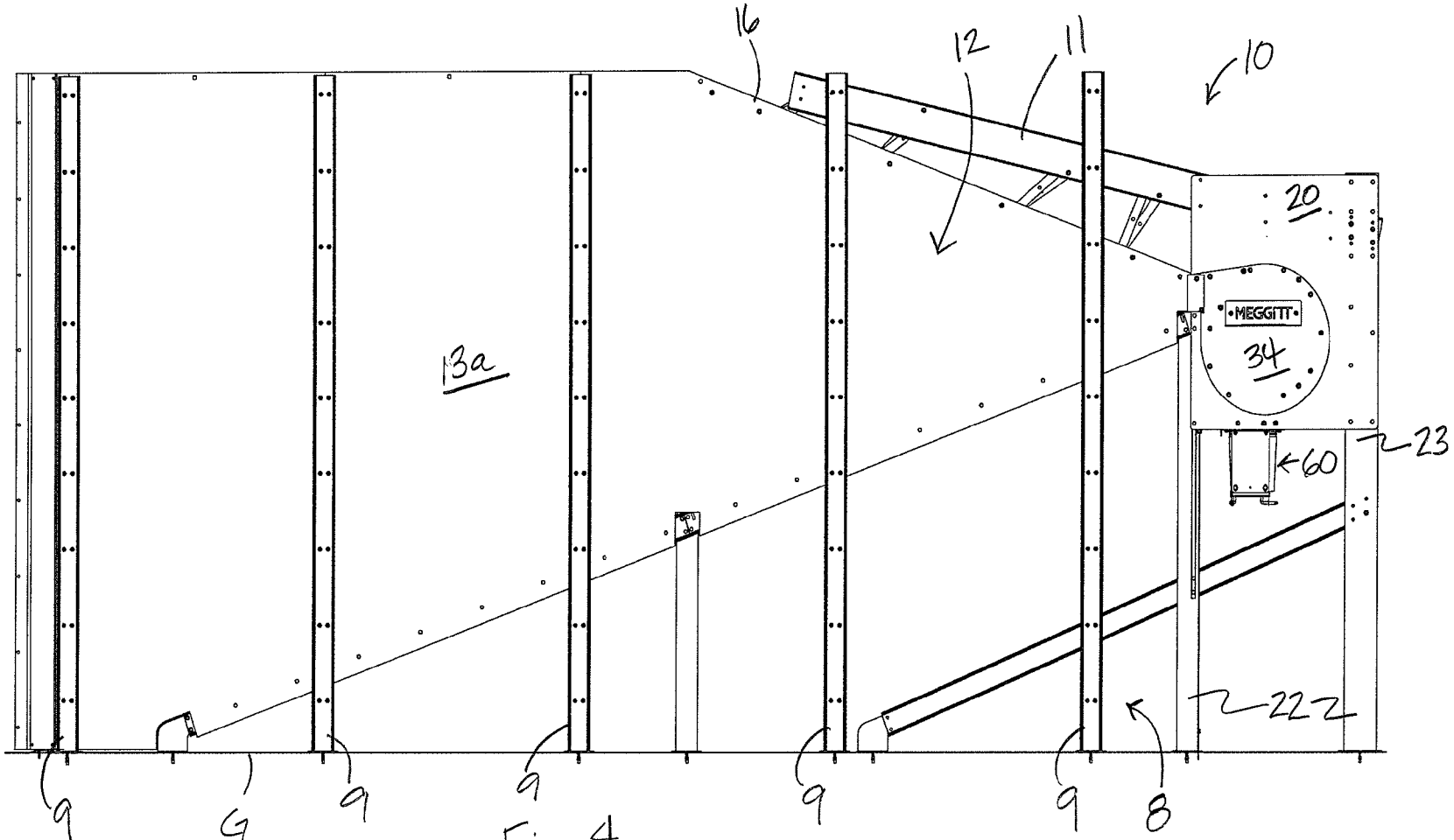
FIG. 4 is a side elevational view of the improved projectile trap assembly.
Figure 5:
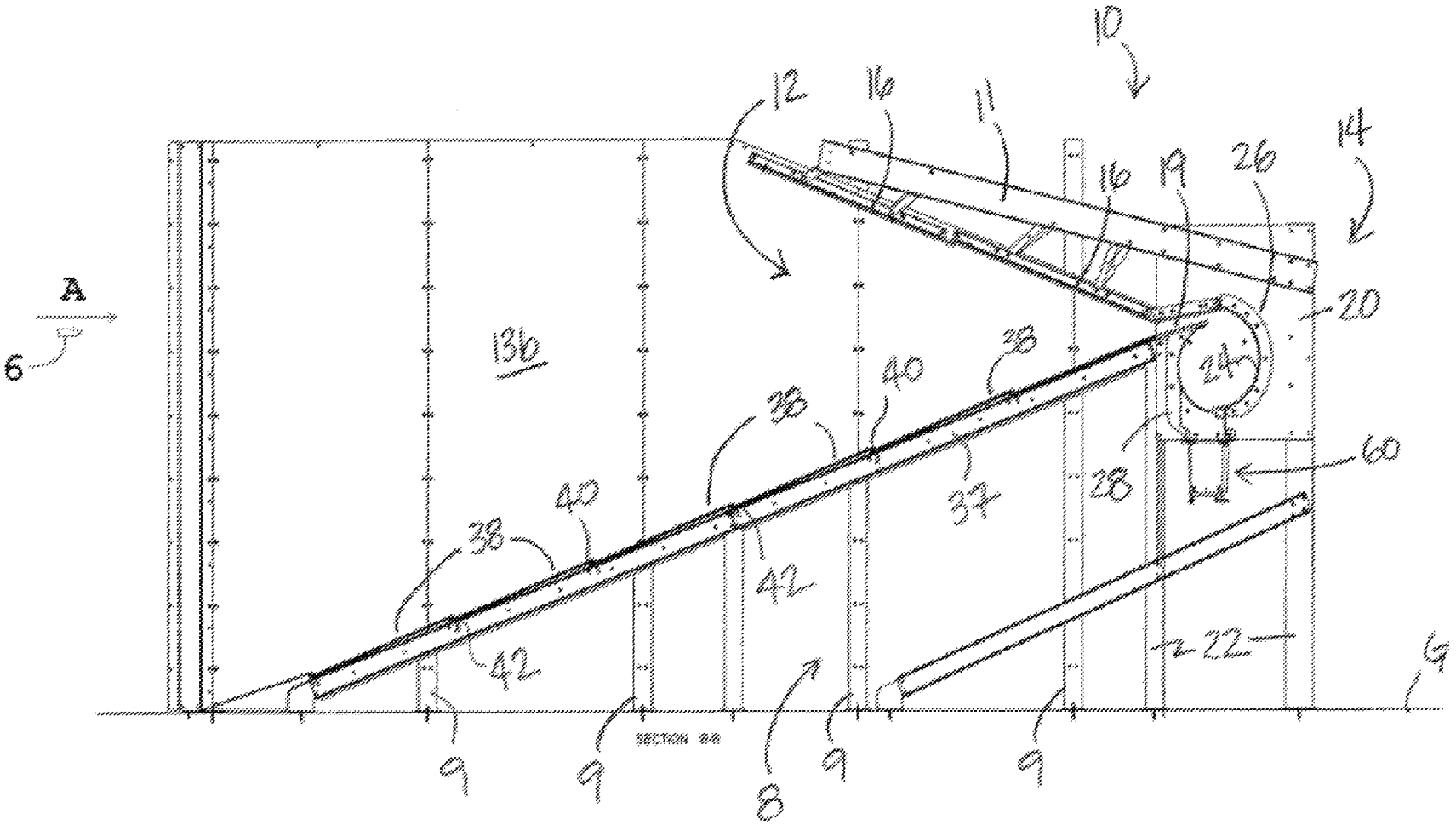
FIG. 5 is a side sectional view of the improved projectile trap assembly taken along lines B-B of FIG. 1.
Figure 6:
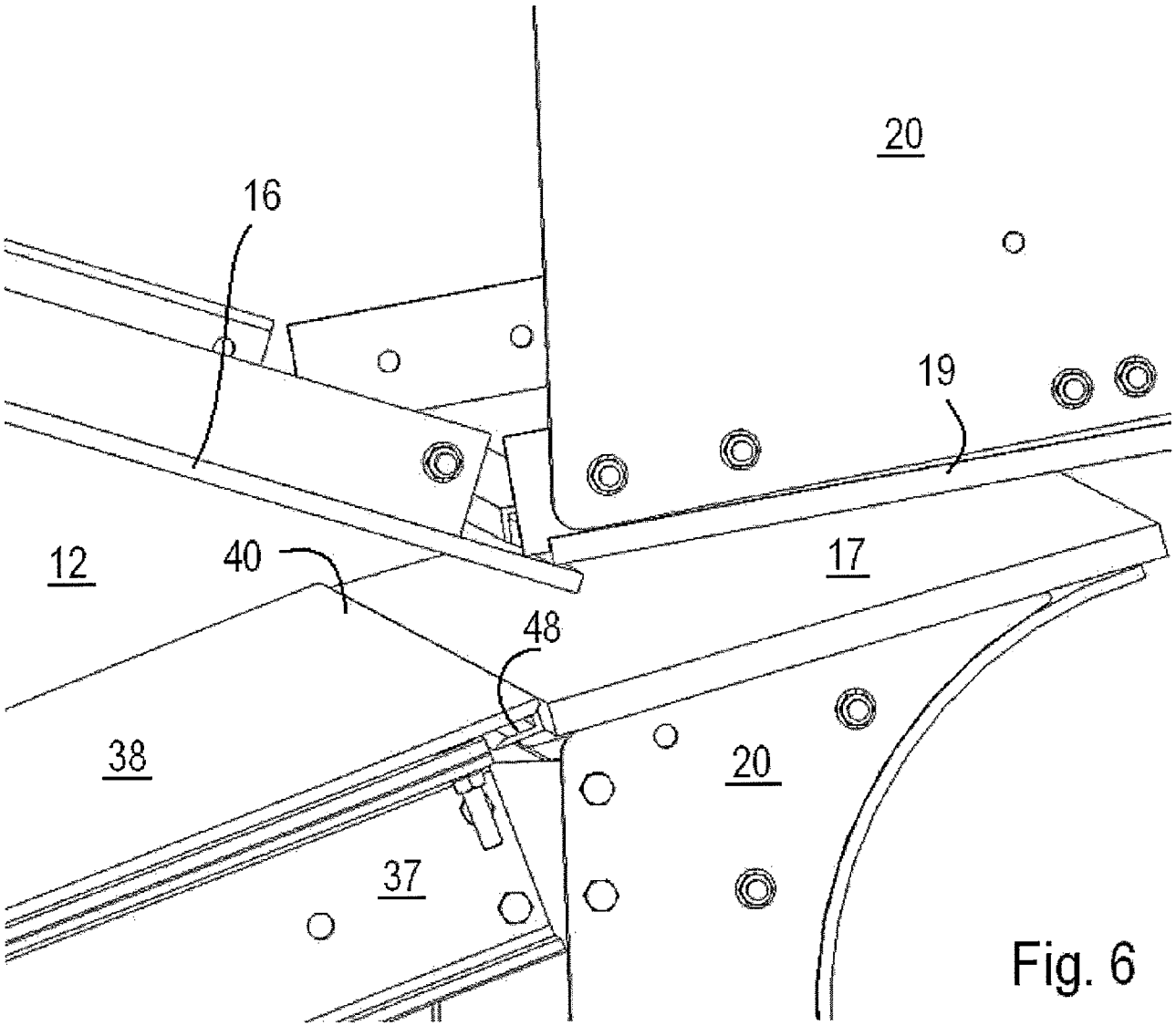
FIG. 6 is a magnified perspective view of the improved projectile trap assembly.

Looking to FIGS. 1-3, the improved projectile trap 10 generally includes a framework 8 that supports a channel 12 and a containment chamber 14 on a ground surface G. The framework 8 includes a series of vertical columns 9 (such as C or I channel beams), a series of base support beams 37 (such as C channel beams) positioned between a ground surface G and the containment chamber 14 (see FIG. 5), and a series of upper trap support beams 11 (see FIG. 2). The channel 12 is defined by a series of upper plates 16 and a series of lower reversible plates 38. The upper plates 16 are connected to the framework 8 via the upper trap support beams 11. The lower reversible plates 38 are supported on a number of base support beams 37 as described herein, with the base support beams 37 being affixed to various columns 9 and support legs 22 of the framework 8 at an upward angle from the ground surface G. The upper plates 16 and reversible lower plates 38 lead to an upper throat plate 19 and a lower throat plate 17, respectively, and define an ingress for bullets into the containment chamber 14. In addition, a pair of side walls 13*a*, 13*b* (made of up of a series of independent panels) are affixed to columns 9 on respective sides of the trap 10 to further define the channel 12.

Referring to FIGS. 1-8, the containment chamber 14 includes at least a pair of floating bulkhead plates 20. Each bulkhead plate 20 is detachably affixed to an upper end of a pair of support legs 22, with a bulkhead aperture 24 traversing the bulkhead plate 20 generally corresponding to the shape of the ends of a scroll assembly 21, as discussed in more detail herein. The bulkhead plates 20 are positioned on opposite ends of the width of a scroll assembly 21 to support the scroll assembly 21. Each bulkhead plate 20 is a steel plate that separates and mounts the scroll assemblies 21 and supports the upper trap support beam 11. It is independently supported by two columns 22, and therefore can stand alone when other pieces are removed.

The scroll assembly 21 includes a rear scroll cover 26 and a front scroll cover 28 that are connected between two bulkhead plates 20, and the front scroll cover 28 may be slightly offset from the rear scroll cover 26 (see FIGS. 2, 5, 8, 21 and 22). The front scroll cover 28 and the rear scroll cover 26 are each connected between two bulkhead plates 20. The front scroll cover 28 includes base plates 27*a* and 27*b* having a length substantially corresponding to the width of the lower plates 38, with two attachment plates 29 on opposite sides of the length of the base plates 27*a*, 27*b* to be affixed to the bulkhead plates 20. The bottom edges of base plates 27*a*, 27*b* and attachment plates 29 define an egress aperture 51 that is substantially closed by an adapter plate 31. The adapter plate 31 is affixed below the bottom edges of the front scroll cover 28 via conventional fasteners (such as bolts). This allows use of a bucket assembly 60, as described herein, when a bucket collection system is desired. The egress aperture 51 of the front scroll cover 28 may alternatively be used as an attachment point for other types of collection systems, such as screw or belt conveyors. In addition, a knock-out hole is present in the front scroll assembly 28 that provides an optional connection to a ventilation system if desired by the user.

The adapter plate 31 includes two long edges turned up into flanges that are bolted to the bottom of the front scroll assembly 28. The adapter plate 31 further defines several large discharge holes 31*a* having a diameter slightly less (but substantially matching) the diameter of the mouths of the buckets 62 used in the assembly 10. The width of a trap section can vary from 24 inches to 60 inches in six inch increments, to better allow fitting into different width rooms (four feet wide is typical). Correspondingly, this adapter plate 31 comes in as several widths, with more bucket mounting holes for wide trap sections, and less for narrower ones.

Figure 7:
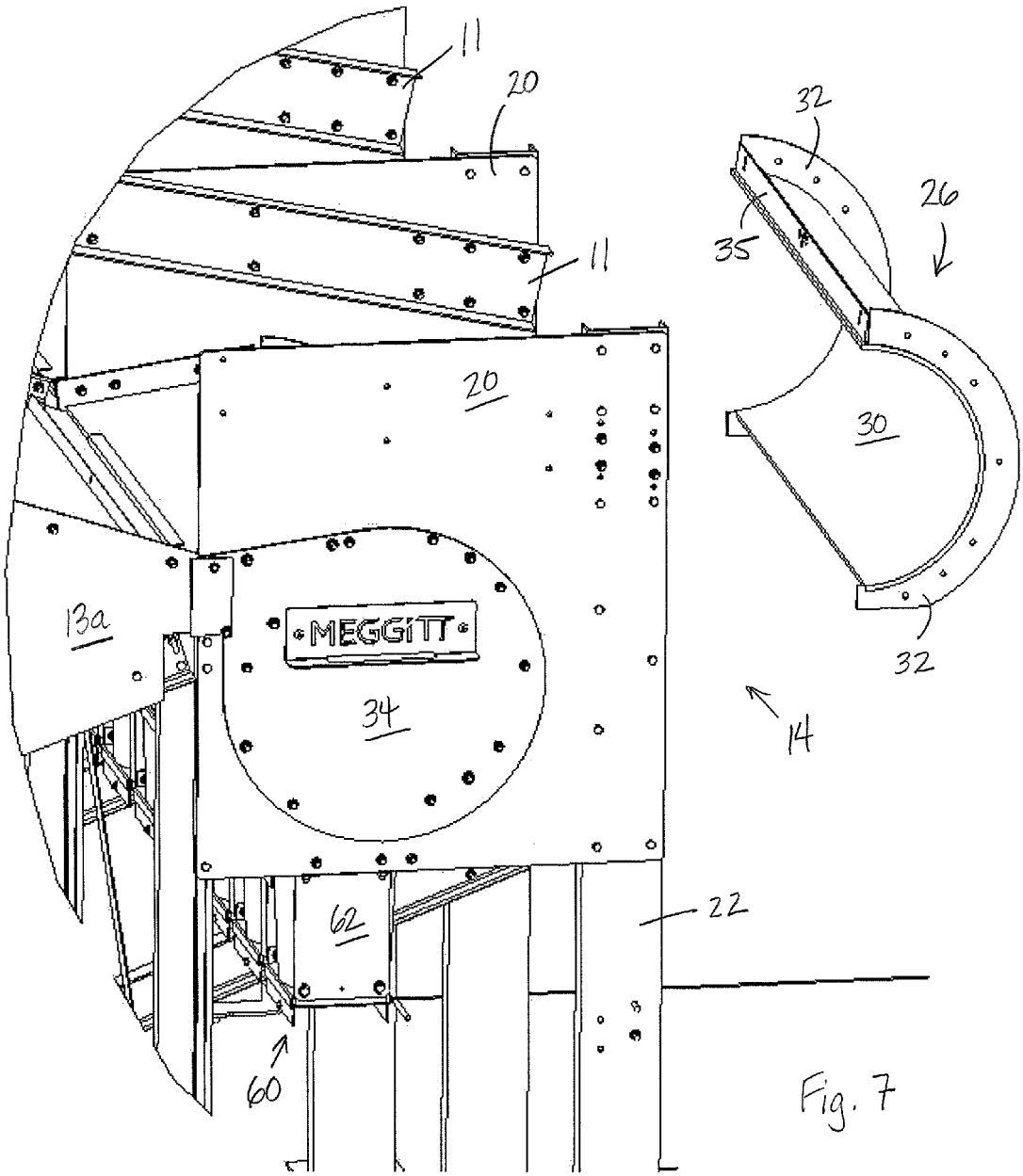
FIG. 7 is a partially exploded perspective view of the improved projectile trap assembly.
Figure 10:
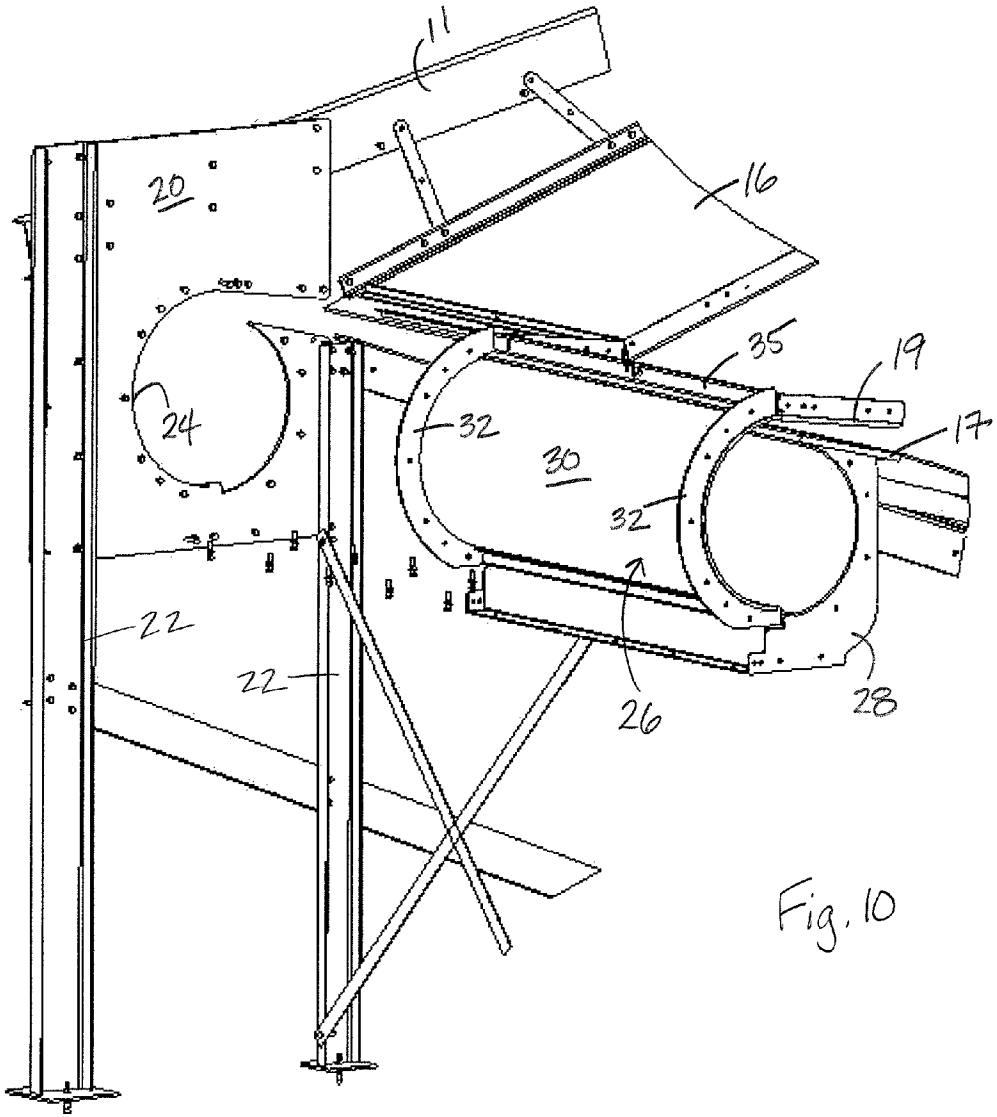
FIG. 10 is a partially exploded perspective view of the improved projectile trap assembly.

As further shown in FIGS. 7 and 10, the rear scroll cover 26 includes a curved plate 30 having arcuate side flanges 32 extending from opposite curved edges of the cover 26 and a main front flange 35 extending between the side flanges 32, the main front flange proximate the upper throat plate 19. The side flanges 32 are detachably connected to the bulkhead plates 20 via conventional connectors (such as bolts), such that the rear scroll cover 26 of the scroll assembly 21 is readily removable for inspection, cleaning, or replacement. In a typical slow-deceleration scroll-type steel bullet trap, the rear surface of the scroll is welded in place, which is difficult to remove without significant disassembly of other components. Cleaning efforts are therefore hampered by poor accessibility of the inner rear scroll surface in conventional designs. However, the present design includes the removable rear scroll 26 that can be readily cleaned or replaced without replacement of the entire scroll assembly.

The removable rear scroll 26 is important in allowing much easier inspection, and, even more importantly, much easier cleaning and service of the rear scroll 26. That is, if the scroll assembly 21 is not maintained, it can become gradually caked with lead and debris, leading to obstruction of the outlets, or worse, to material regurgitation that can injure the shooter.

Figure 11:
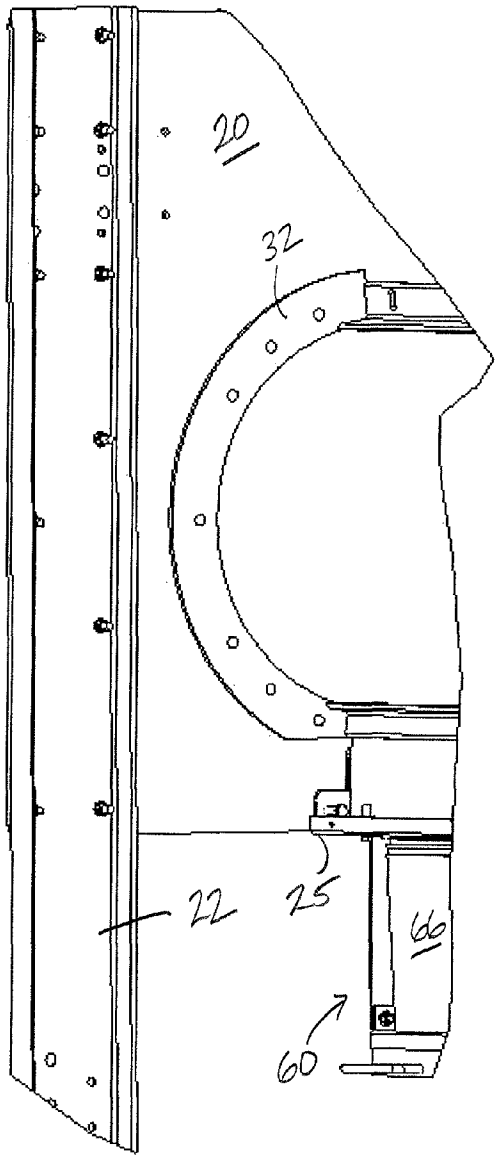
FIG. 11 is a sectional view of the bulkhead plates of the improved trap assembly.

Looking to FIG. 11, the assembly 10 has an integral scroll removal jacking points 25. Generally speaking, steel bullet traps tend to be difficult to service because of the sheer weight of the parts as well as assembly adhesions and binding. Standard assembly bolts are screwed into specific locations on the scroll assembly 21 to jack apart the bulkhead plates 20 and nearby scroll parts to allow ready removal of the rear scroll 26. The present design, however, includes a screw-action jacking system at jacking points 25 that pries apart the scrolls 16 for cover removal. Specifically, there are integral jacking points 25 on the scroll 16 for scroll rear shell 26 removal and replacement. The jacking point 25 allows much easier manipulation of the necessarily large and sometimes un-cooperative scroll assembly 21. The jacking point 25 works in tandem with the removable rear scroll 26 to provide access to the scroll 16 that is unparalleled by other designs.

Figure 8:
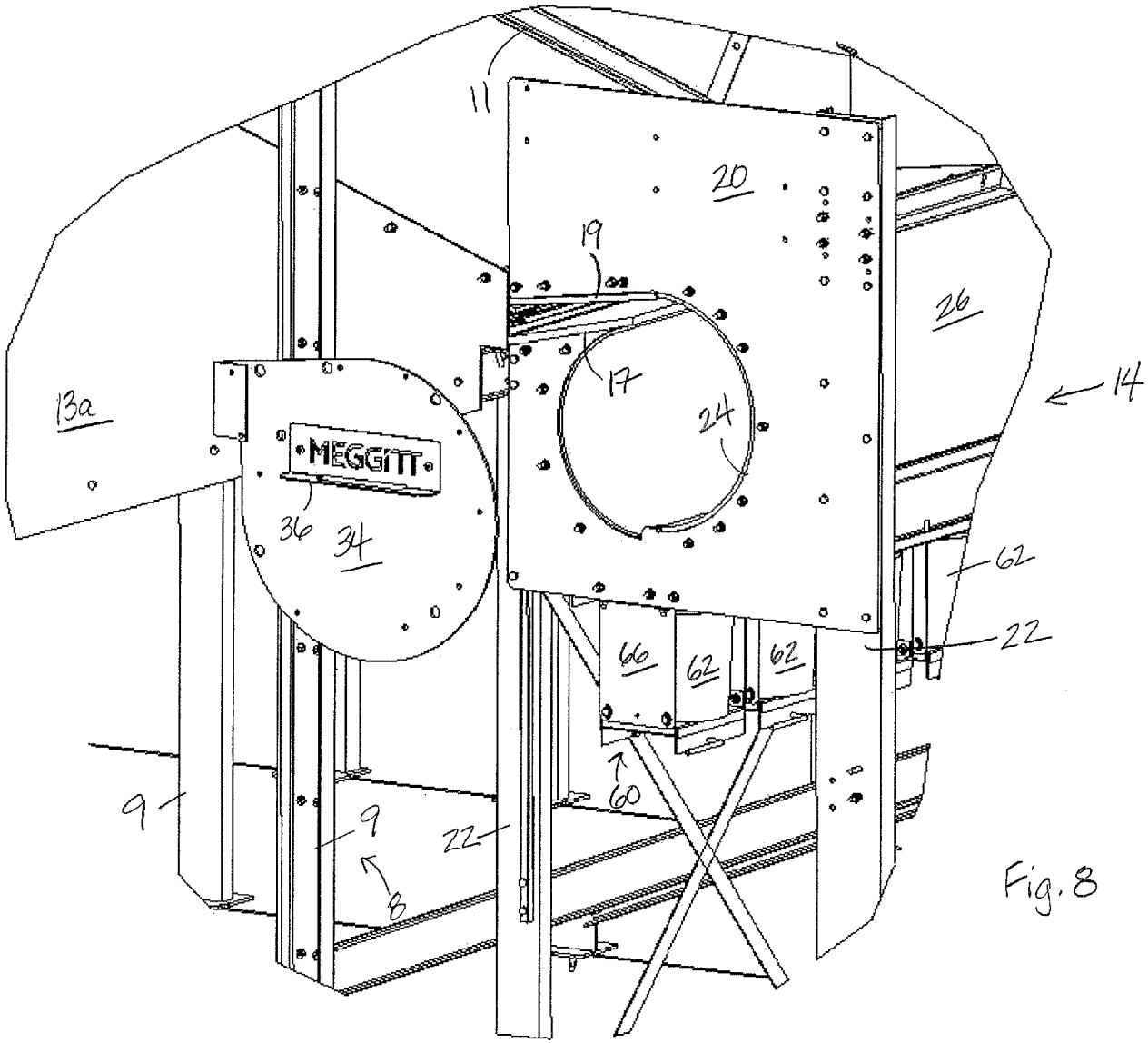
FIG. 8 is a partially exploded perspective view of the improved projectile trap assembly.
Figure 9:
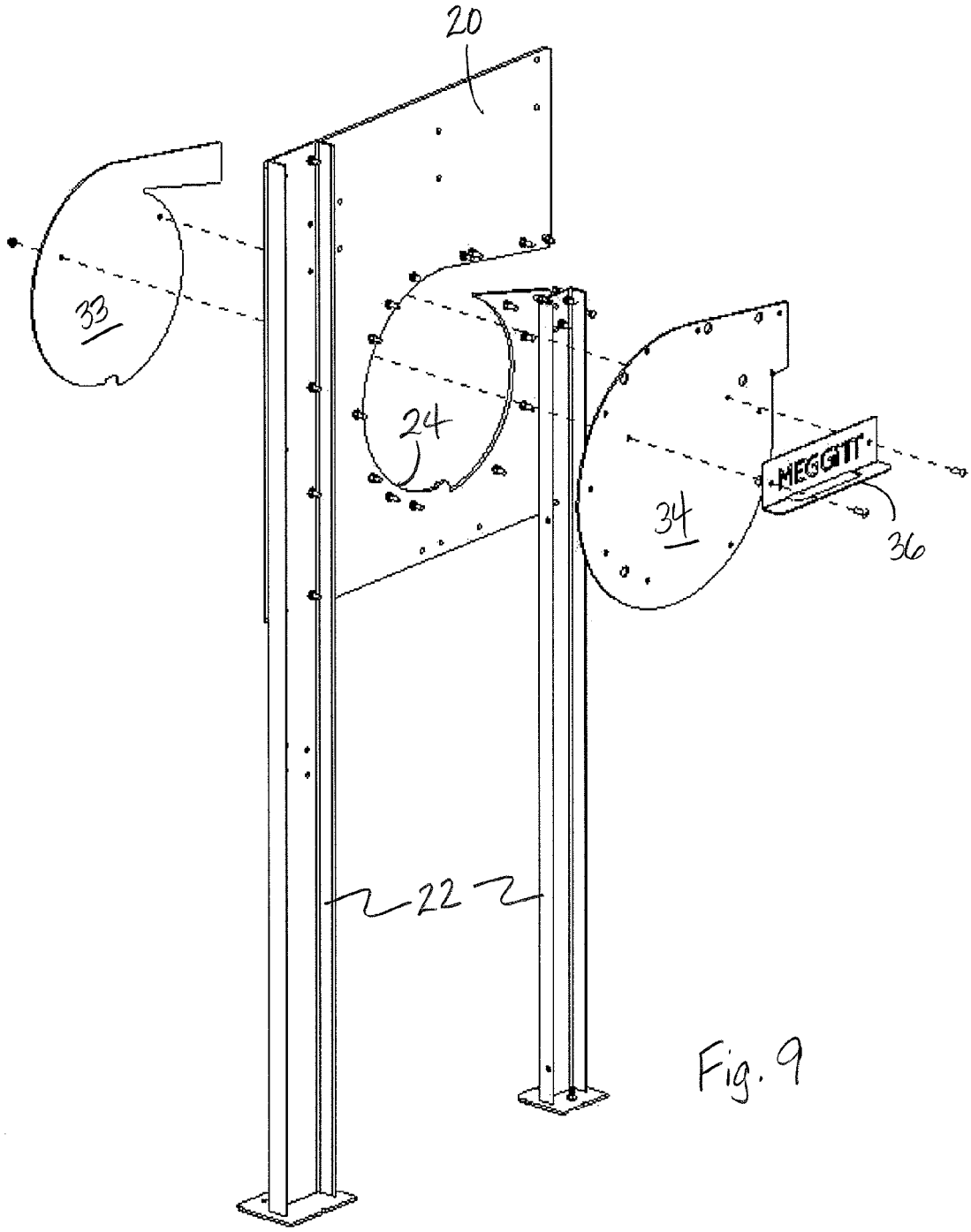
FIG. 9 is a partially exploded perspective view of the bulkhead plates of the improved projectile trap assembly.

Referring to FIGS. 7 through 9, the containment chamber 14 additionally includes removable side covers 34 that may be mounted to the bulkhead plates 20 on a side of the bulkhead plate 20 opposite of the scroll assembly 21. In other bullet trap designs, the scroll assembly is one large weldment that can only be serviced as a whole; a structural building block that cannot easily be removed. Inspection of the actual scroll portion of a scroll-type bullet trap often is difficult because the ends of the scroll are welded or otherwise not easily removed from the housing. The present design includes a simple flat side scroll covers or plates 34 with a handle 36 affixed thereto that can be easily and readily removed from the bulkhead plate 20 to allow limited access to the end areas of the scroll assembly 21 and inside of the scroll assembly 21. This further allows for cleaning, inspection, or replacement of components of the scroll assembly 21. The user will simply join the side plates 34 to the bulkhead plate 20 using a conventional connector, such as bolts or screws. The side scroll covers 34 are lighter and easier to remove than the rear scroll cover 26, so that end-view inspections are quicker and more readily performed.

Referring to FIG. 9, an insert plate 33, having a shape commensurate with the side scroll cover 34, may be connected to the bulkhead plate 20 and the side scroll cover 34 to help keep any bullet debris from seeping out at the side cover seam between the bulkhead plate 20 and the side scroll cover 34. That is, without the insert plate 33, the swirling lead that was shot into the scroll assembly 21 would directly try to escape the scroll assembly 21 at the juncture of the two pinched flat plates 20 and 34. By connecting the insert plate 33 to the bulkhead plate 20 on the side opposite the side scroll cover 34, an additional step/turn is added to greatly diminish joint penetration by the bullet.

Looking to FIG. 10, the use of a single floating bulkhead plate 20 is illustrated. The bulkhead plate 20 is used between the scroll assemblies 21 to allow subassembly replacement. Traditional scroll-type bullet traps employ plates at both ends of each scroll to hold all the parts in place. Usually this means bolting a series of scrolls together at these end plates to form the often long series of lanes used in bullet traps. In contrast, the present design includes a single, floating bulkhead plate 20 that is the basic structural support for the scroll assembly 21, as well as other trap parts, from either side of the scroll assembly 21. Use of the bulkhead plate 20 reduces the amount of steel required in the bullet trap, and allows scroll parts to be replaced with reduced disassembly. The floating bulkhead design provides the "backbone" structure to allow the scroll parts to be serviced and replaced with greatly reduced structural disruption. It drops the modularity of the scroll assembly 21 to a lower level than other known designs, reducing repair and maintenance costs.

Referring now to FIGS. 1-3 and 12-16, lower reversible plates 38 are illustrated. The lower plates on a conventional bullet trap will eventually wear down from repeated ballistic impact during conventional use. The sizes of the plates 38

(length, width, thickness) may vary according to customer requirements (e.g., projectiles from handguns require a thinner plate 38, whereas projectiles from big guns or longer life require a thicker plate 38). The plate 38 most frequently implemented is ⅜ inches thick, but other sizes, such as one-fourth inch and one-half inch, are available according to desired performance and cost. The width of the plate 38 is typically from 24 inches to 60 inches in 6 inch increments, and typical lane width is 48 inches, but military embodiments may be 60 inches. The plates 38 are made according to the desired order, but they generally fill the room width, and avoid seams in the center of a firing lane. In the embodiment illustrated in the attached drawings, there are six plates 38 and one toe plate 38 (the special one at the ground level G that has a flat section to attach to the floor) in each lane (see FIG. 1). There are two upper plates in each section as well.

To address wear, the improved projectile trap assembly 10 incorporates reversible plates 38 that are positioned on the base support beams 37. The arrangement of the reversible plates 38 allows a fresh contact surface to be utilized to periodically renew the trap 10. That is, the present design allows the reversible plates 38 to be removed and flipped without having any protruding fasteners or the need to be held down with external seam covers. This allows for cross-lane shooting between side walls 13*a*, 13*b* (such as the three lane assembly illustrated in FIGS. 1-3) without having any protruding steel parts (such as joints or fasteners) that would create a ricochet hazard for the user.

Figure 12:
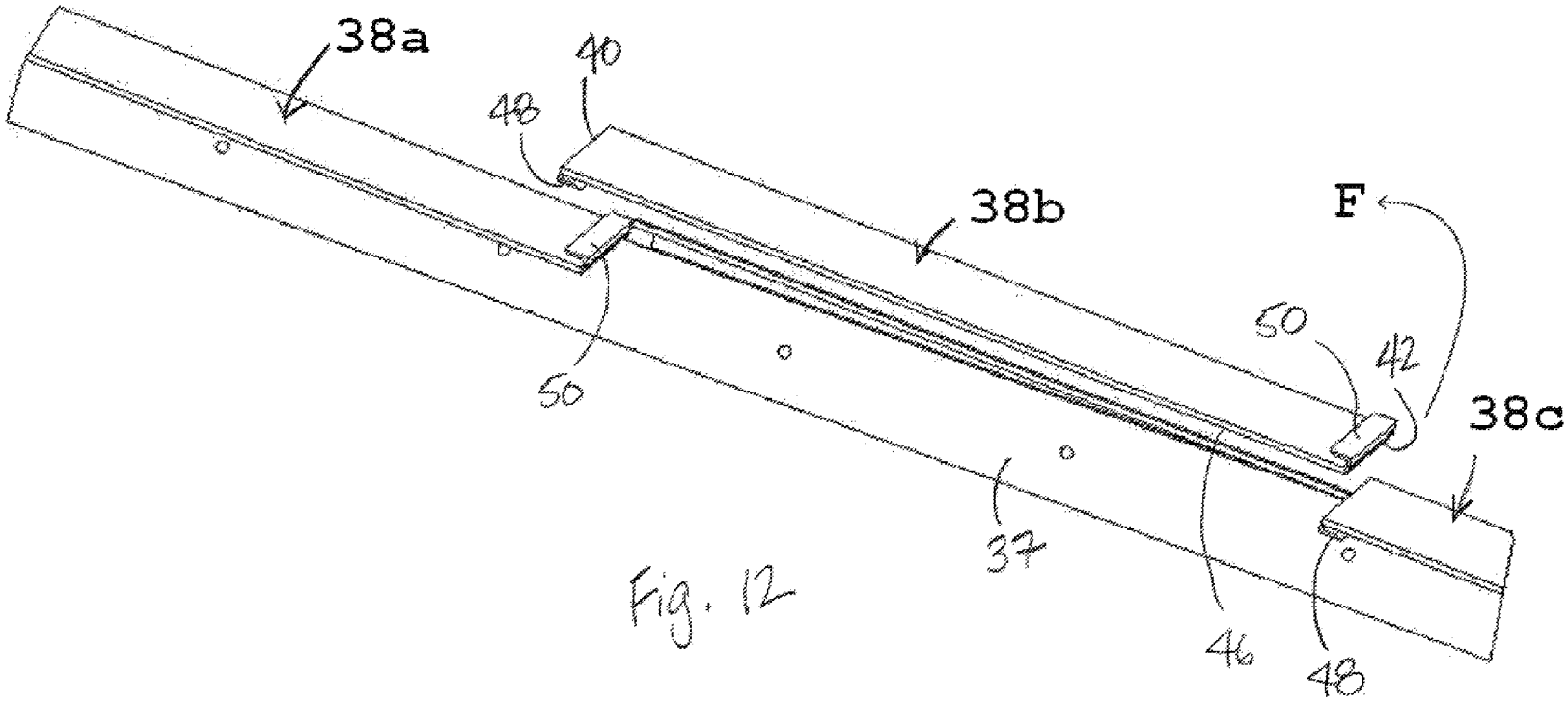
FIG. 12 is a perspective view of the reversible plates of the improved trap assembly.
Figure 13:
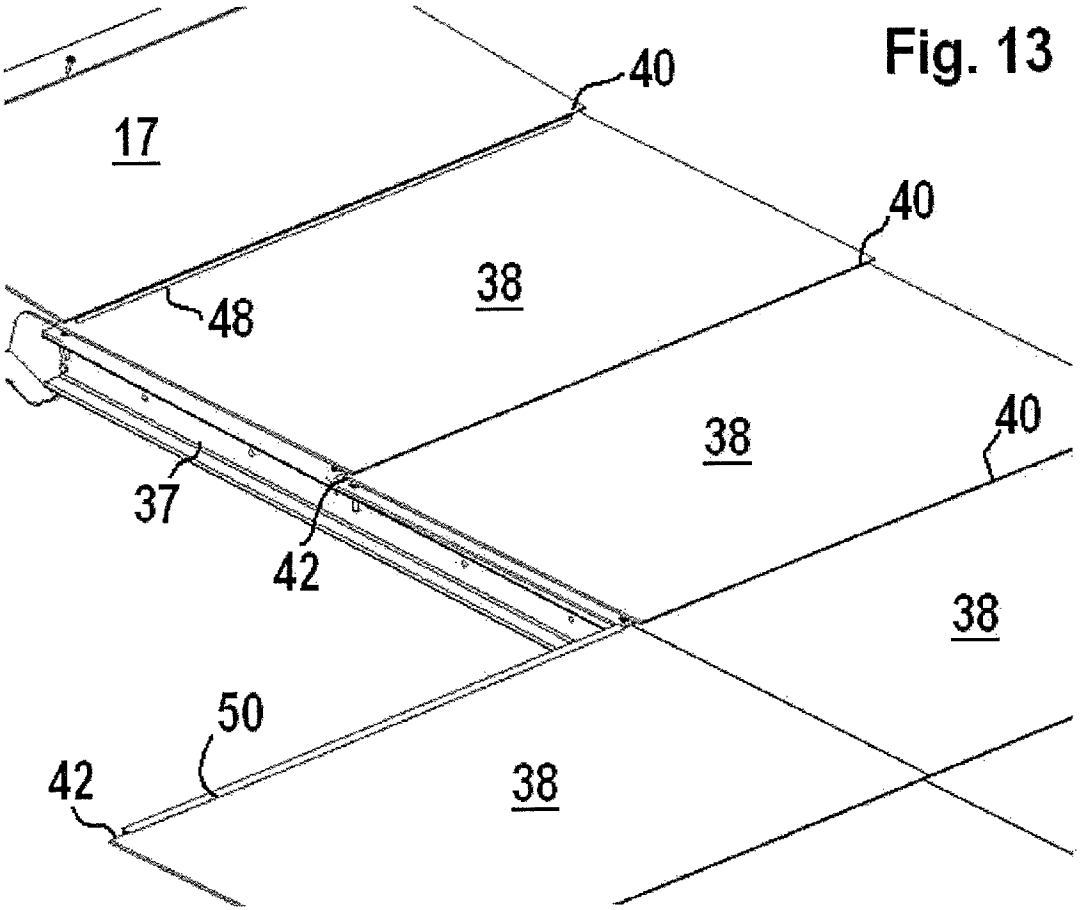
FIG. 13 is a perspective view of the reversible plates of the improved trap assembly.

More specifically, referring to FIGS. 12 and 13, each reversible plate 38 has a length from a first end or edge 40 to a second end or edge 42, with the reversible plate 38 having a top surface 44 and a bottom surface 46. A first lip 48 or flange extends in from the first end 40 of the reversible plate 38 to a position parallel to either the top surface 44 or the bottom surface 46. The lip 48 may extend in a curved fashion or it may have an L-shape. A second lip 50 or flange fashion from the second end 42 of the reversible plate 38 to a position parallel to the surface opposite of the first lip 48. The lip 50 may extend in a curved fashion or it may have an L-shape. As a result, the first lip 48 of one reversible plate 38 may engage the second lip 50 of an adjacent reversible plate 38 to form the desired surface for deflecting projectiles 6 (see FIGS. 1 and 12-14).

When the user determines that the top surface 44 is worn from contact from projectiles 6 and no longer meets the safety requirements, the present assembly 10 provides a means for providing a smooth surface with the same reversible plates 38. That is, one or more reversible plates 38 may simply be disengaged from the abutting reversible plates 38, and one end 40, 42 may be flipped to turn over the subject reversible plate 38. For example, looking to FIG. 12, the first lip 48 of reversible plate 38B originally engages the second lip 50 of reversible plate 38A and the second lip 50 of reversible plate 38B originally engages the first lip 48 of reversible plate 38C. The reversible plate 38B may be disengaged from the adjacent plates 38A, 38C, and the second end 42 of the reversible plate 38B may be flipped in direction F (although the plate 38B may be flipped in any direction as desired by the user). The reversible plate 38B can once again be connected with the adjacent reversible plates 38A, 38C, with the first lip 48 of reversible plate 38B then engaging the first lip 48 of reversible plate 38C and the second lip 50 of reversible plate 38B will then engage the second lip 50 of reversible plate 38A. As a result, the former bottom surface 46 will become the contacted surface rather than the former top surface 44, and provide a fresh surface for the projectile trap assembly 10. It is to be noted that although this example indicates that only one plate is turned over, multiple plates 38 in the assembly 10 may be flipped at one time to provide the desired surface.

Looking further to FIGS. 12-16, the reversible plates 38 are supported by the base support beams 37. In even more detail, it is noted that a small backing plate 39 and spacer 41 are positioned between each reversible plate 38 and support beam 37 to further support the joints between adjacent reversible plates 38. The backing plate 39 in the illustrated embodiment is a strip of one-quarter inch thick steel that is about two inches wide and corresponds in length to the length of the reversible plate 38. The backing plate 39 is bolted to the support beam 37 via connectors (bolts) 43, with the spacer 41 being positioned at one end of the backing plate 39 to elevate one end of the backing plate 39 at an incline from the support beam 37. The spacers 41 hold up the upper end of the lower plates 38 to allow proper plate overlap and interlock with adjacent lower plates 38. The reversible plates 38 rest on the backing plate 39, and since the lower plates 38 all interlock in a long chain, gravity is used to hold them all in place on the support beams 37. While the trap 10 is operational without the backing plates 39 and spacers 41, there would be a slight gap between adjacent plates 38 if the components were not positioned accordingly. Thus, the backing plates 39 and spacers 41 prevent a leakage path for bullets between adjacent plates 38.

Figure 14:
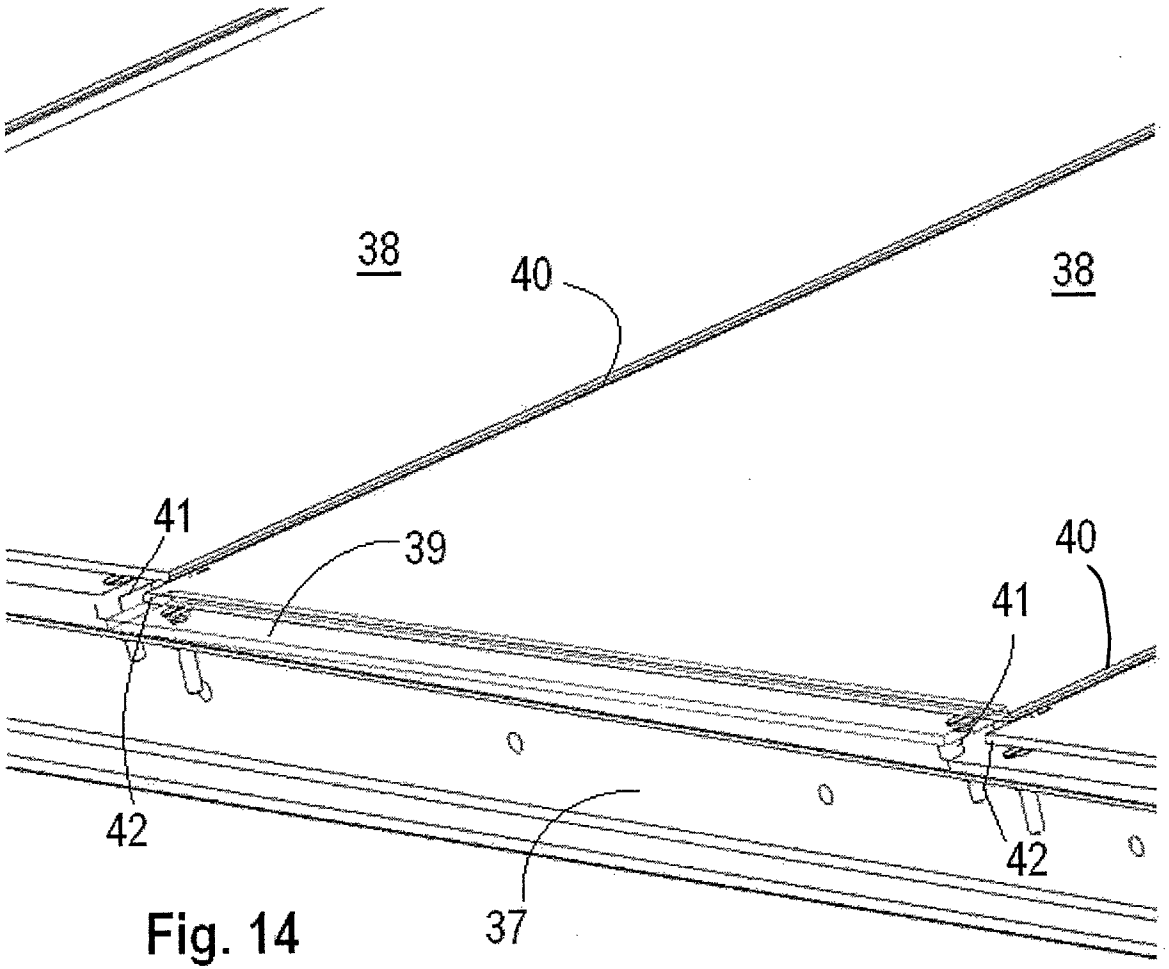
FIG. 14 is a perspective view of the reversible plates of the improved trap assembly.
Figure 15:
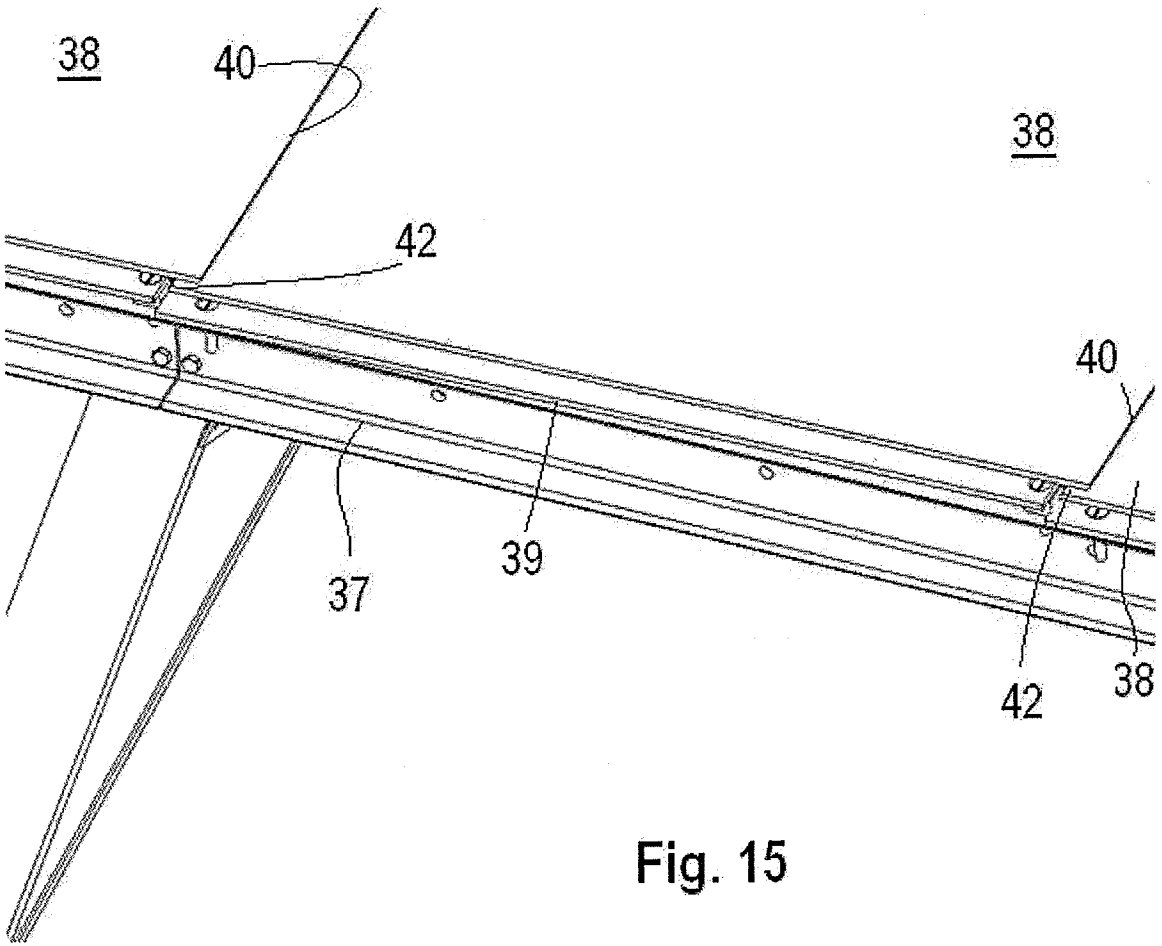
FIG. 15 is a perspective view of the reversible plates of the improved trap assembly.
Figure 16:
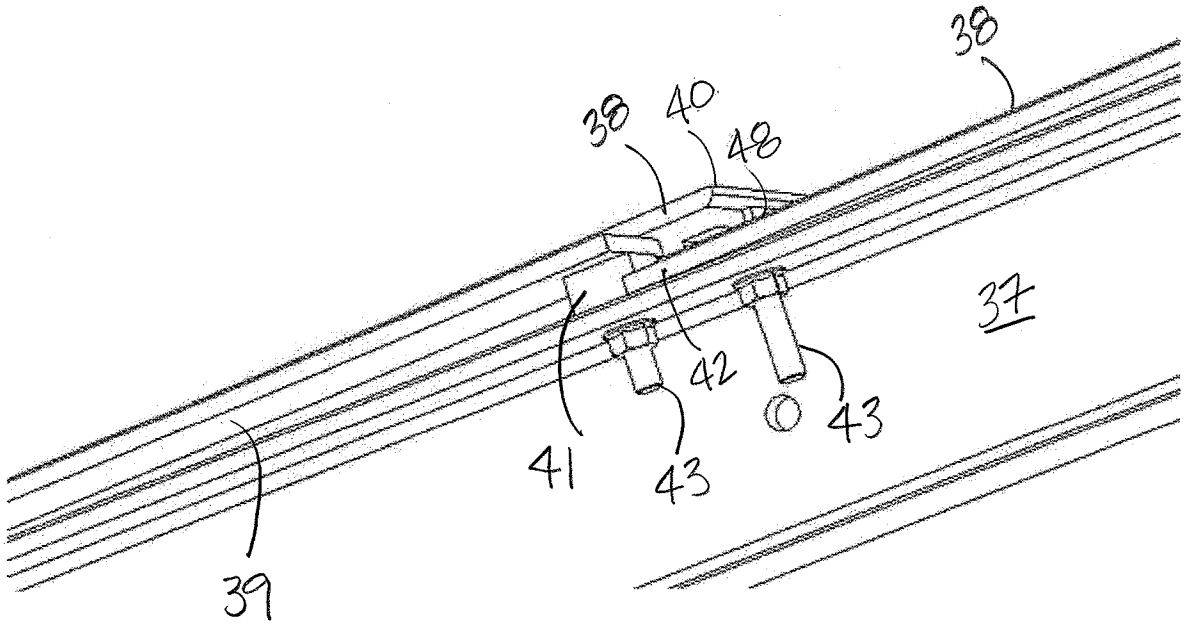
FIG. 16 is a side perspective view of the reversible plates of the improved trap assembly.
Figure 17:
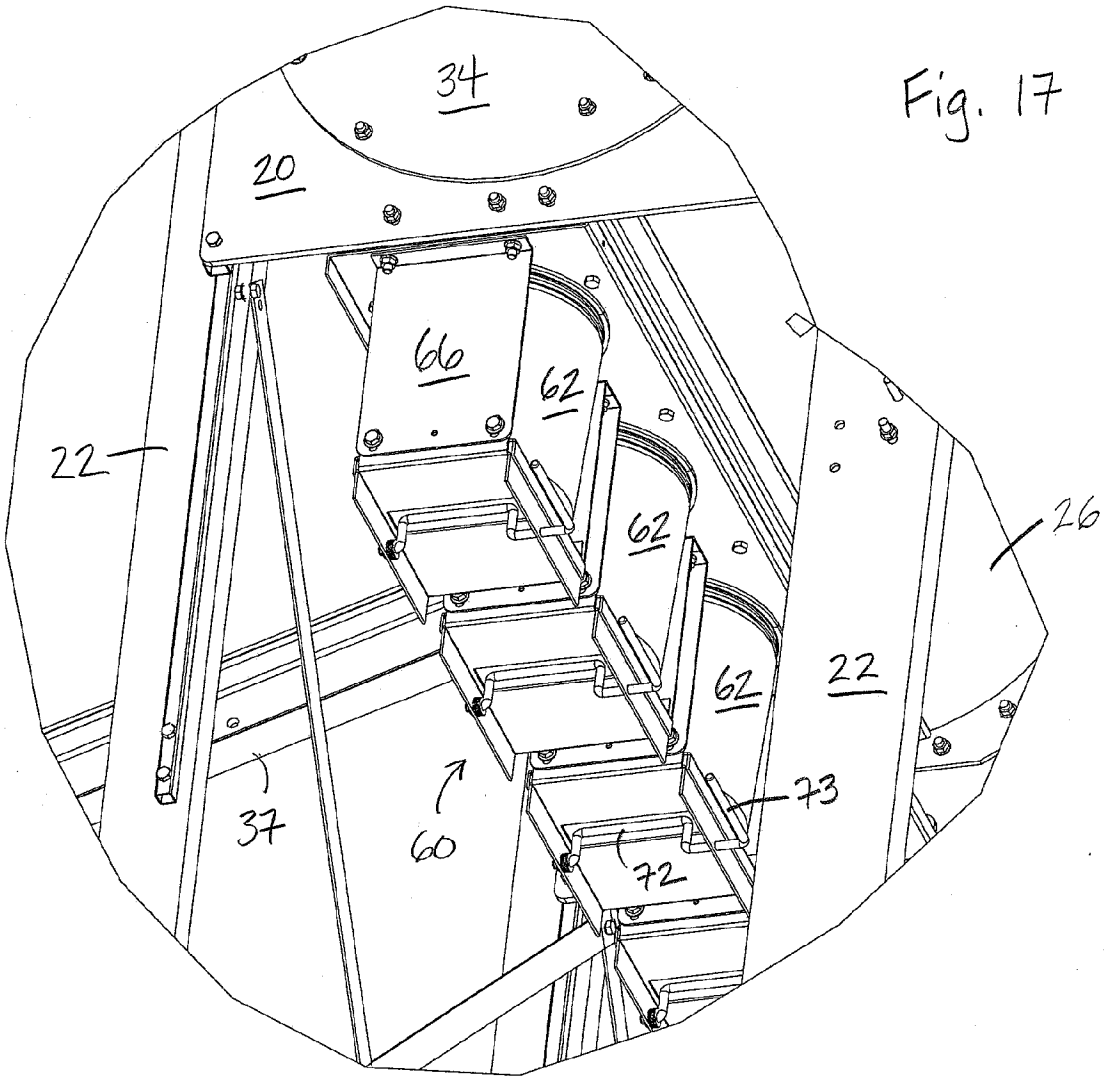
FIG. 17 is a bottom perspective view of the bucket replacement assembly.
Figure 18:
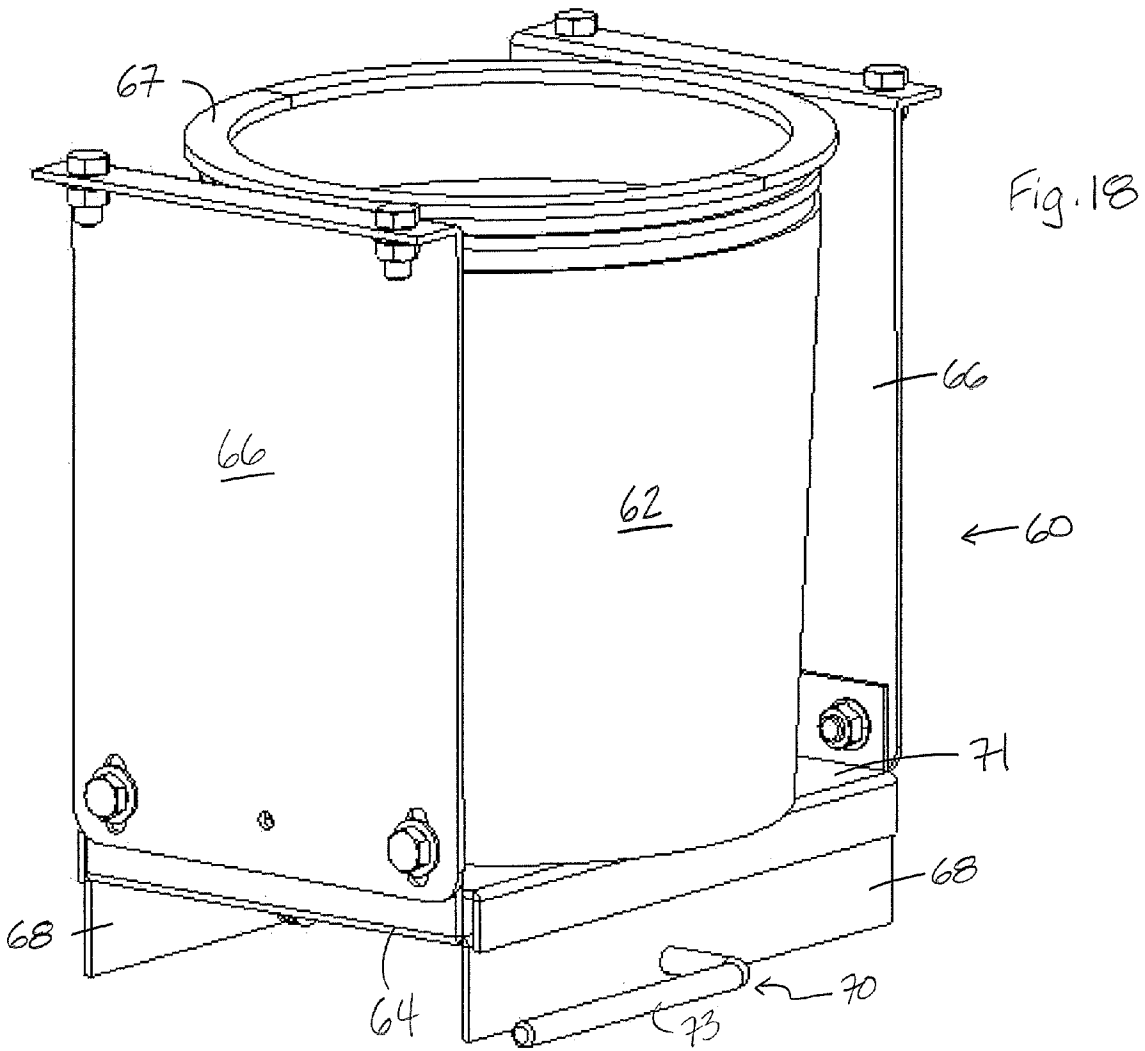
FIG. 18 is a perspective view of the bucket replacement assembly.
Figure 19:
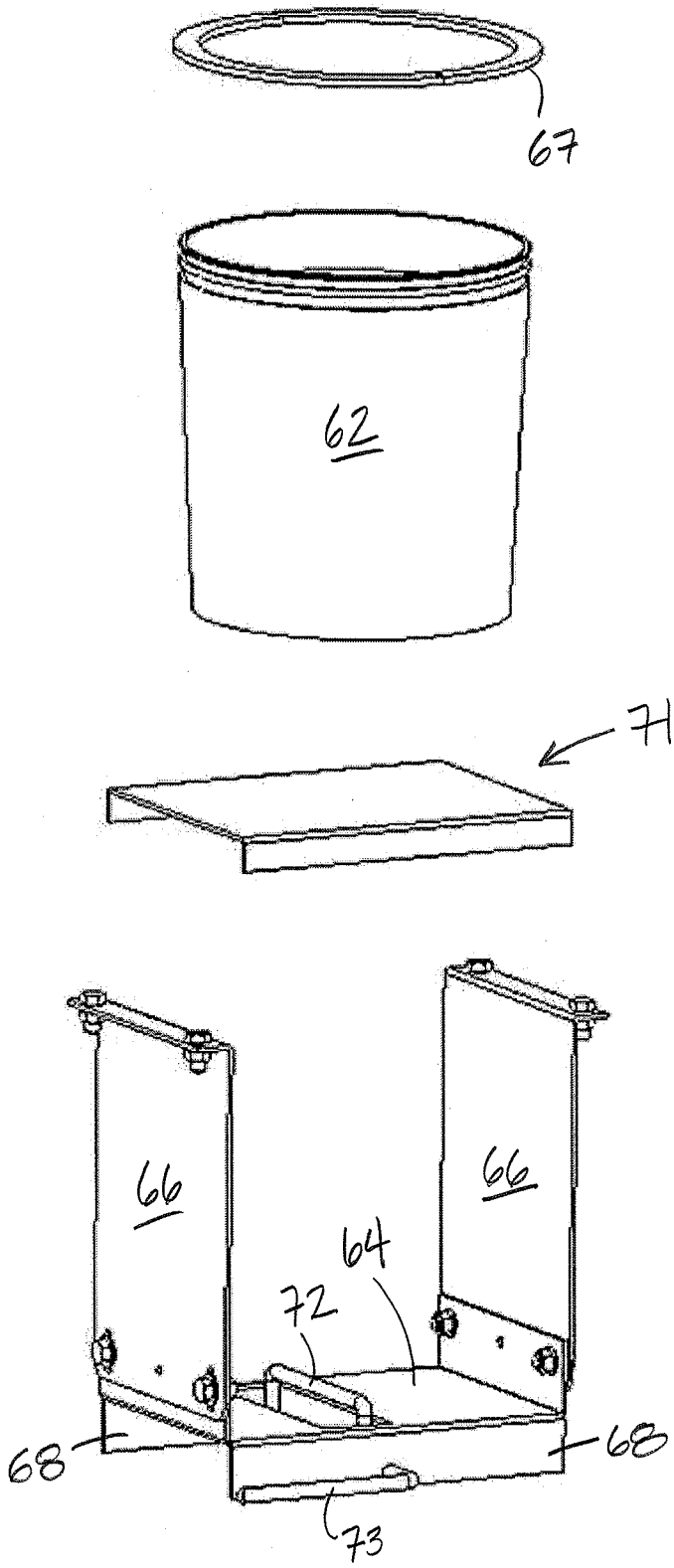
FIG. 19 is a front exploded view of the bucket replacement assembly.
Figure 20:
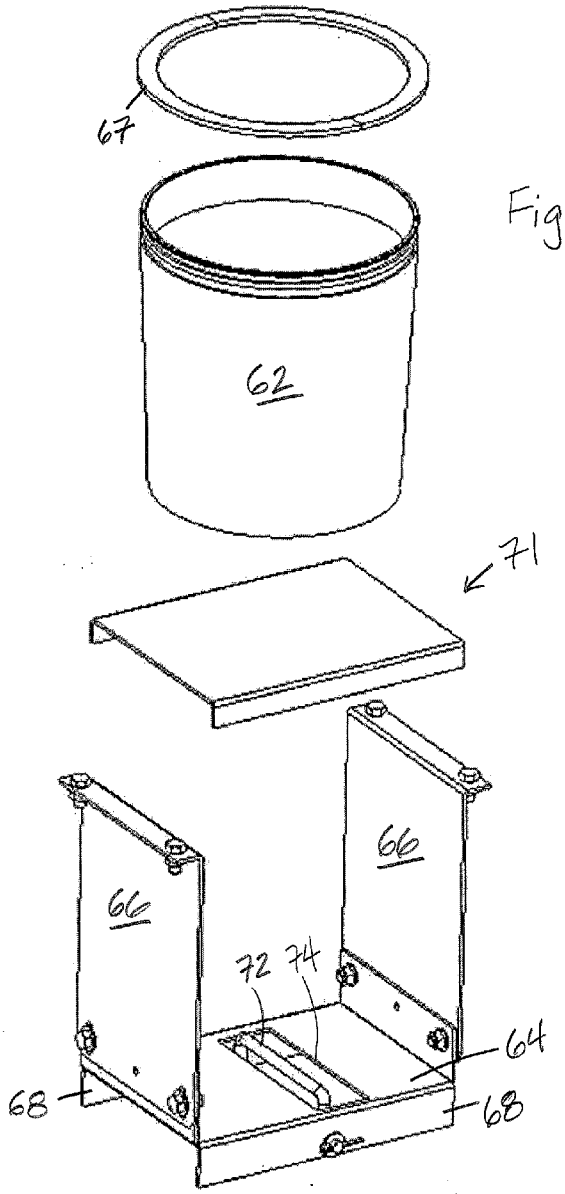
FIG. 20 is a rear exploded view of the bucket replacement assembly.
Figure 21:
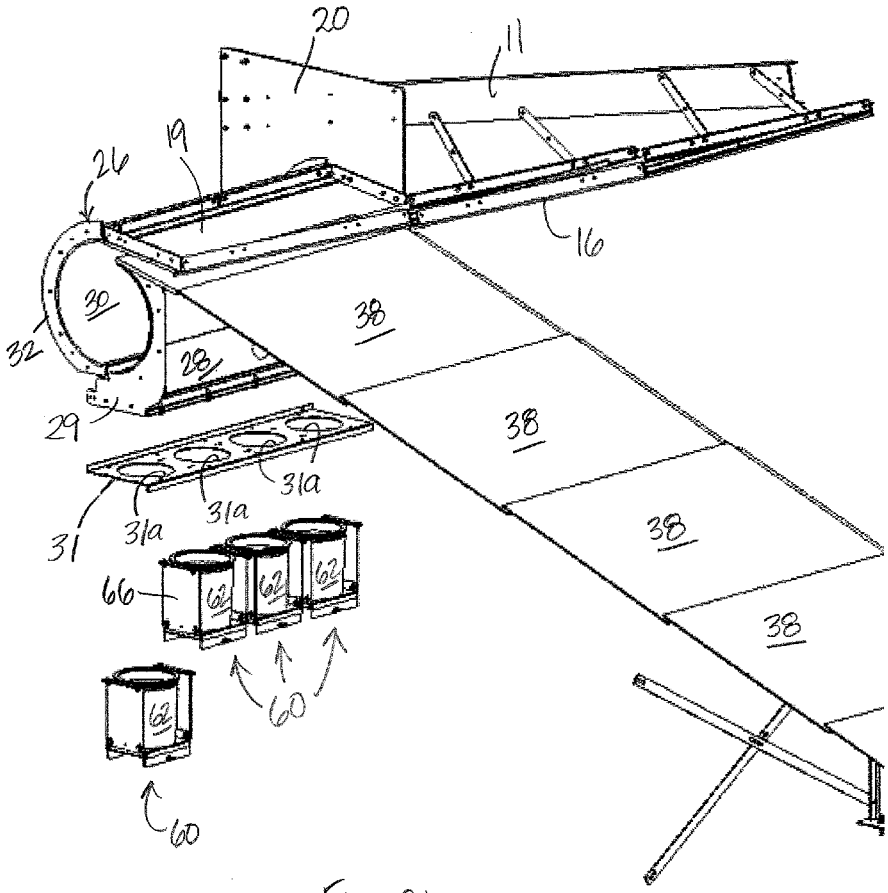
FIG. 21 is a rear exploded view of the improved trap assembly.
Figure 22:
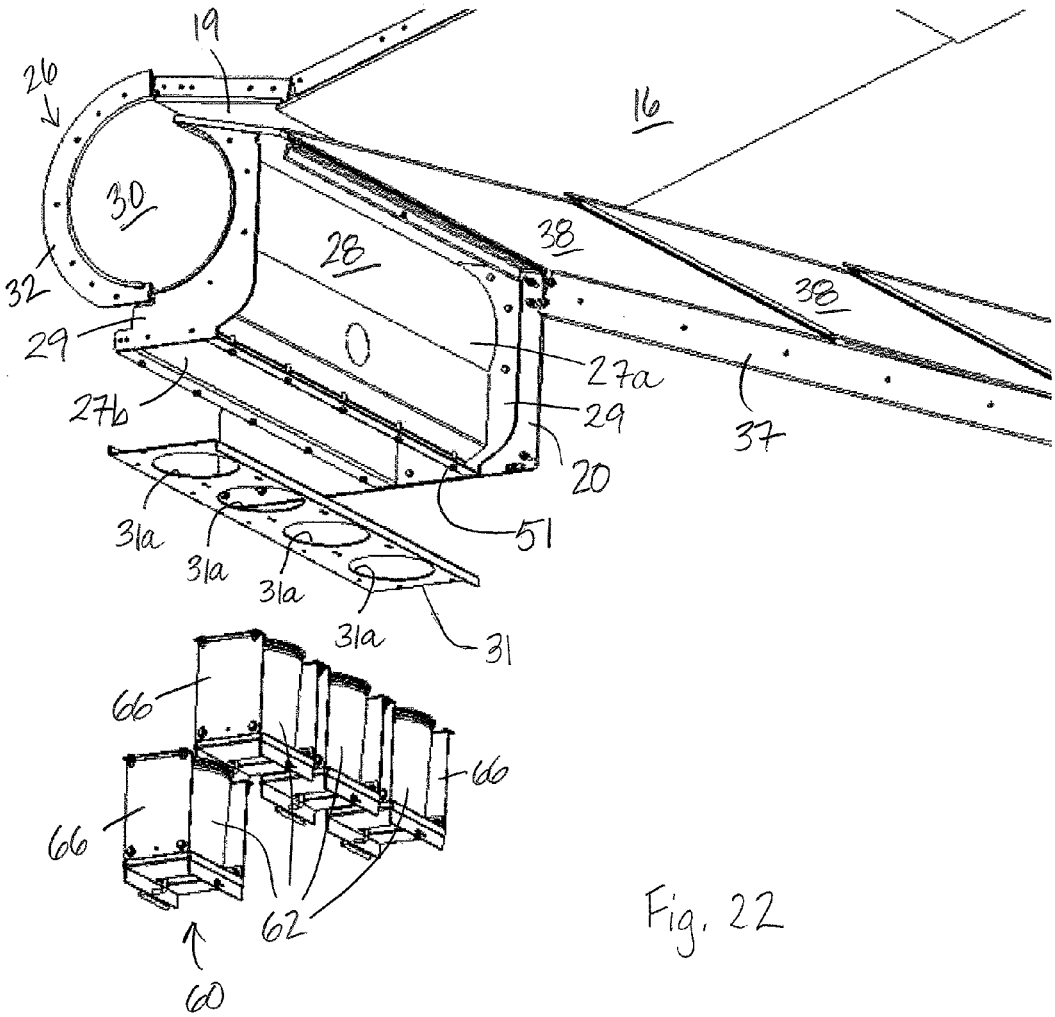
FIG. 22 is a bottom exploded view of the improved trap assembly.

Steel bullet traps of the scroll design usually have a series of flat deflection plates that direct the bullet to the rear scroll area, and one important feature that is desirable from a usage standpoint is having deflection plates that have no protruding features that could reflect back bullets towards the shooter. When there is a wider bullet trap with a multitude of shooting lanes, any feature that protrudes into the lanes, even along the shooting axis, can cause unforeseen and unwanted ricochet when the shooter fires across the lanes laterally. In some trap designs, there are seam covers between shooting lanes that can allow this to happen. The reversible deflection plates 38 solve this problem, in that they have no seam covers, and also may be flipped over when worn to extend useful service life. More specifically, a first reversible plate 38 is positioned proximate the lower throat plate 17, and the top lip simply drops into a recess and is held down by gravity (see FIG. 6). The first lip 48 of a second plate 38 then slips over the second lip 50 of the first plate 38, such that the reversible plates 38 are connected without a seam. This may continue with as many reversible plates 38 as desired by the user (as shown in FIGS. 1 and 14), although it may preferable to only offer one slope angle for the lower and upper plates 38, with a corresponding fixed number of plates. If more plates 38 are added to the design, the angle would need to be shallower, or the trap 10 would need to be taller. Therefore, the customer typically will only be able to select the width and thicknesses of the plates 38 without adjusting the angles or height of the same. This hook-channel design offers a simple, low cost means to meet both the reversibility and anti-ricochet requirements.

Looking to FIGS. 1 and 18-22, the bucket replacement assembly 60 referenced above is positioned beneath the containment chamber 14 for collection and disposal of expired projectiles 6 from the containment chamber 14. That is, bullet traps 10 collect the waste lead from spent rounds, and allow the waste lead to be removed to keep the trap 10 operating without becoming packed with debris. There are many types of lead collection systems used on scroll-type traps. These include screw and belt conveyance into a larger container, or as in the case of most lower-cost systems, bucket collection. The buckets 62 fill with the bullets and other trap debris, and are removed and replaced when they are full.

As noted above, the adapter plate 31 is bolted to the bottom of the front scroll assembly 28. The buckets 62 are positioned for selective engagement with this adapter plate 31. If this plate is left off, then the two front scroll flanges 29 are ready to accept some other means of collection, such as screw or belt conveyor.

Although some bullet trap designs have used buckets to collect the waste material, the present design includes a mechanism that allows unlatching of a bucket 62 with a single motion, and a lift platform 64 that helps support the weight of the bucket 62 when removing and replacing. This provides a one-handed easily activated debris bucket replacement mechanism. The present design includes a bucket support and retrieval assembly 60 with a dust seal 67 when in place. The bucket assembly 60 includes a bucket 62 that is supported on a base plate 64 with two side walls 66 affixed to opposite sides of the base plate 64, such that the bucket 62 is sandwiched between the side walls 66. A pair of lower flanges 68 are connected to the base plate 64 and extend downwardly along the edge of the base plate 64. Further, a support plate 71 is positioned between the bottom of the bucket 62 and the base plate 64.

A lever 70 is rotatably mounted between the lower flanges 68, and includes a raised element 72 and a handle 73. In the embodiment shown, the raised element 72 lies in a plane at a right angle to that of the handle 73. A lever aperture 74 traverses the base plate 64 proximate the raised element 72 of the lever 70, such that when the lever 70 is rotated, the raised element 72 will extend through the lever aperture 74 to engage the support plate 71 positioned on the base plate 64. The raised element 72 will then force the support plate 71 upward, and the bucket 62 into engagement with the scroll adapter plate 31 surrounding the discharge holes 31*a* in the lower portion of the containment chamber 14 to capture projectiles 6 shot into the assembly 10. A circular dust seal 67 is positioned proximate the top of the bucket 62, such that when the bucket 62 is forced upward, the seal 67 will be sandwiched between the scroll adapter plate 31 and the bucket 62. When desired, the user will simply rotate the lever 70 approximately 90 degrees to release the connection, with the raised element 72 no longer applying an upward force on the support plate 71 and thereby lowering the bucket 62 on to the base plate 64. The user will be able to remove and replace or clean the bucket 62 from the base plate 64 as desired. Unlike other bucket replacement designs, the bucket 62 is released instantly with a one-handed effort, saving considerable time for the user who has to replace or clean a typically long line of buckets 62 for the various shooting lanes.

In operation, as a projectile 6 or bullet is fired in direction A, it will travel from the wide opening in the channel 12 between the narrow opening. If the projectile 6 is not aligned to the opening to the containment chamber 14, it will be deflected by the lower plate 38 or upper plate 16 back into an aligned direction. The projectile 6 will pass through the ingress between the lower and upper throat plates 17, 19 and in to the scroll assembly 21. Once the bullet slows down, it will traverse an aperture between the rear scroll cover 26 and the front scroll cover 28 and be dispersed into an adjacent bucket 62. At the desired time, the user will engage the lever 70 of the bucket assembly 60 to release the bucket 62 for cleaning. Furthermore, the user will be able to simply and easily detach the removable side covers 34 and/or the rear scroll cover 26 to clean out any residue or trash contained in the scroll assembly 21.

Having thus described exemplary embodiments of an improved projectile trap assembly, it should be noted by those skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims.

What is claimed is:

1. An improved projectile trap assembly comprising:
- a frame;
- a containment chamber supported by said frame, said chamber having an ingress portion and an egress portion and comprising
  - a pair of bulkhead plates connected to said frame and defining a bulkhead aperture;
  - a front scroll affixed to each said bulkhead plate proximate said aperture;
  - a rear scroll detachably connected to each said bulkhead plate proximate said aperture and slightly offset from said front scroll; and
  - a side plate detachably connected to each of said bulkhead plates on a side opposite of said respective front scroll and said rear scroll, said side plate providing selective access to said containment chamber;
- upper and lower trap plates supported by same frame leading to said ingress point of said containment chamber, wherein said lower trap plates extend from a first edge to a second edge and comprise:
- a first lip extending along a portion of said first edge; and
- a second lip extending along a portion of said second edge;
- wherein said first lip on a first lower trap plate engages said second lip on an adjacent second lower trap plate.

2. The trap as described in claim 1, wherein said frame comprises:
- a plurality of vertical columns supporting said containment chamber;
- a plurality of support beams extending upward from the ground surface to a position proximate said ingress portion of said containment chamber to support said lower trap plates; and
- a plurality of upper trap support beams affixed to said bulkhead plates to support said upper trap plates.

3. The trap as described in claim 1 wherein said position of said first lower trap plate may be flipped with respect to said adjacent lower trap plate to provide a new firing surface.

4. The trap as described in claim 1 further comprising:
- an adapter plate affixed to said front scroll, said adapter plate defining at least one discharge hole; and
- at least one collection bucket positioned below said front scroll in an adjustable closed or open position proximate said at least one discharge hole, said at least one collection bucket being removable in said open position.

5. The trap as described in claim 4 further comprising:
- a base plate with two side walls affixed to opposite sides of the base plate and a bucket aperture traversing said base plate, said bucket positioned on said base plate between said side walls;
- a pair of lower flanges extending downward from said base plate;
- a lever rotatably mounted between said lower flanges to selectively force said at least one bucket into contact with said adapter plate.

6. The trap as described in claim 5 wherein said lever comprises a raised element to selectively engage said bucket and a handle.

7. The trap as described in claim 6 wherein said raised element lies in a plane at a right angle to that of said handle.

8. The trap as described in claim 5 further comprising a circular dust seal positioned proximate a top surface of said bucket.

9. The trap as described in claim 5 further comprising a support plate between the bottom of the bucket and the base plate.

10. The trap as described in claim 1 wherein said rear scroll is detachably affixed to each said bulkhead plate.

11. An improved projectile trap assembly comprising:

a frame;

a containment chamber supported by said frame, said chamber having an ingress portion and an egress portion and comprising a pair of bulkhead plates connected to said frame and defining a bulkhead aperture;

a front scroll affixed to each said bulkhead plate proximate said aperture;

a rear scroll detachably connected to each said bulkhead plate proximate said aperture and slightly offset from said front scroll; and a side plate detachably connected to each of said bulkhead plates on a side opposite of said respective front scroll and said rear scroll, said side plate providing selective access to said containment chamber;

upper and lower trap plates supported by same frame leading to said ingress point of said containment chamber;

an adapter plate affixed to said front scroll, said adapter plate defining at least one discharge hole; and at least one collection bucket positioned below said front scroll in an adjustable closed or open position proximate said at least one discharge hole, said at least one collection bucket being removable in said open position;

a base plate with two side walls affixed to opposite sides of the base plate and a bucket aperture traversing said base plate, said bucket positioned on said base plate between said side walls;

a pair of lower flanges extending downward from said base plate; and a lever rotatably mounted between said lower flanges to selectively force said at least one bucket into contact with said adapter plate.

12. The trap as described in claim 11, wherein said frame comprises:

a plurality of vertical columns supporting said containment chamber;

a plurality of support beams extending upward from the ground surface to a position proximate said ingress portion of said containment chamber to support said lower trap plates; and a plurality of upper trap support beams affixed to said bulkhead plates to support said upper trap plates.

13. The trap as described in claim 11 wherein said lower trap plates extend from a first edge to a second edge and comprise:

a first lip extending along a portion of said first edge; and a second lip extending along a portion of said second edge;

wherein said first lip on a first lower trap plate engages said second lip on an adjacent second lower trap plate.

14. The trap as described in claim 13 wherein said position of said first lower trap plate may be flipped with respect to said adjacent lower trap plate to provide a new firing surface.

15. The trap as described in claim 11 wherein said lever comprises a raised element to selectively engage said bucket and a handle.

16. The trap as described in claim 15 wherein said raised element lies in a plane at a right angle to that of said handle.

17. The trap as described in claim 11 further comprising a circular dust seal positioned proximate a top surface of said bucket.

18. The trap as described in claim 11 further comprising a support plate between the bottom of the bucket and the base plate.

19. The trap as described in claim 11 wherein said rear scroll is detachably affixed to each said bulkhead plate.

20. An improved projectile trap assembly comprising:

a frame;

a containment chamber supported by said frame, said chamber having an ingress portion and an egress portion;

upper and lower trap plates supported by same frame leading to said ingress point of said containment chamber, wherein said lower trap plates extend from a first edge to a second edge and comprise:

a first lip extending along a portion of said first edge; and a second lip extending along a portion of said second edge;

wherein said first lip on a first lower trap plate engages said second lip on an adjacent second lower trap plate.

* * * * *